US005469836A

United States Patent [19]

Greenall

[11] Patent Number: 5,469,836

[45] Date of Patent: Nov. 28, 1995

[54] SOLID FUEL HEATING APPLIANCE

[76] Inventor: Jonathan Greenall, More Works, Squilver Hill, Bishops Castle, England, SY9 5HH

[21] Appl. No.: 104,058

[22] PCT Filed: Feb. 14, 1992

[86] PCT No.: PCT/GB92/00268

§ 371 Date: Sep. 24, 1993

§ 102(e) Date: Sep. 24, 1993

[87] PCT Pub. No.: WO92/14972

PCT Pub. Date: Sep. 3, 1992

[30] Foreign Application Priority Data

Feb. 14, 1991 [GB] United Kingdom ..... 9103161

[51] Int. Cl.[6] ..... F24C 1/14

[52] U.S. Cl. ..... 126/77; 126/198; 126/193; 126/60

[58] Field of Search ..... 126/193, 198, 126/200, 163 R, 77, 76, 152 B, 290, 60, 83; 110/214, 210; 237/50, 52

[56] References Cited

U.S. PATENT DOCUMENTS

| | | | |
|---|---|---|---|
| 844,292 | 2/1907 | Thurston | 126/77 |
| 907,867 | 12/1908 | Palmer . | |
| 2,337,847 | 12/1943 | Conkell | 126/75 |
| 4,383,517 | 5/1983 | Gillis et al. | 126/77 |
| 4,426,992 | 1/1984 | Martenson | 126/77 |
| 4,475,529 | 10/1984 | Milligan | 126/77 |
| 4,475,533 | 10/1984 | Milligan | 126/279 |
| 4,483,312 | 11/1984 | Martenson | 126/77 |
| 4,611,572 | 9/1986 | Martenson | 126/77 |

(List continued on next page.)

FOREIGN PATENT DOCUMENTS

| | | | |
|---|---|---|---|
| 1166911 | 5/1984 | Canada . | |
| 0176323 | 4/1986 | European Pat. Off. . | |
| 0250239 | 12/1987 | European Pat. Off. . | |
| 900982 | 7/1945 | France | 126/77 |
| 8712826.8 | 3/1988 | Germany . | |
| 490194 | 8/1938 | United Kingdom . | |
| 2172989 | 10/1986 | United Kingdom . | |
| 2189026 | 10/1987 | United Kingdom . | |
| WO84/02568 | 7/1984 | WIPO . | |
| WO88/06700 | 9/1988 | WIPO . | |

OTHER PUBLICATIONS

Energy King brochure, "*Add a Little Warmth to Your Life*" (2 pages).

The Stack Manufacturing Company Limited brochure, "*Stack High Energy Combustion Stoves Vista 640/Combi 640*" (4 pages).

Kent brochure, "*The Fires that Burn Twice*" (7 pages).

Meridian brochure, "*Meridian Wood Burning Heaters*" (8 pages).

Charnwood Fireclass brochure, "*Fireclass–The Fire in a Class of its Own*" (6 pages).

Charnwood Stoves brochure, "*Look into the Features & Versatility of a Multi–Fuel Stove*" (4 pages).

*Primary Examiner*—James C. Yeung

*Attorney, Agent, or Firm*—Baker, Maxham, Jester & Meador

[57] ABSTRACT

A stove (1) comprises a fire-box (4), and an ash-chamber (5) separated by a grate (19). Air intake means (21,23) is provided beneath the ash-chamber. Air supply means (30) connected to the air intake means extends vertically past the ash-chamber and the fire-box to an upper region of the fire-box. Air delivery means (27) provides communication between the air supply means and the fire-box. In use fuel burning inside the fire-box causes external air to be drawn into the air intake means, through the air supply means and through the air delivery means to a region above fuel in the fire-box. External air is pre-heated by passing underneath the ash-chamber and past the ash-chamber and the fire-box during its passage into the fire-box. Turbulence caused by an interaction between pre-heated air entering the fire-box and heated air already present causes smoky combusted air (F) to be pushed away from a dose (35) at the front of the fire-box.

5 Claims, 2 Drawing Sheets

U.S. PATENT DOCUMENTS

| | | | |
|---|---|---|---|
| 4,643,165 | 2/1987 | Chamberlain | 126/77 |
| 4,658,801 | 4/1987 | Black | 126/77 |
| 4,665,889 | 5/1987 | Rumens et al. | 126/77 |
| 4,683,868 | 8/1987 | Ferguson | 126/193 |
| 4,766,876 | 8/1988 | Henry | 126/77 |
| 4,856,491 | 8/1989 | Ferguson et al. | 126/77 |
| 4,941,451 | 7/1990 | Gilham | 126/77 |

SOLID FUEL HEATING APPLIANCE

FIELD OF THE INVENTION

This invention relates to a heating appliance, particularly a stove, and a means of pre-heating air that is to be consumed in the burning of solid fuel contained within the stove. The heating stove is of the kind having a fire box with an ash-chamber.

BACKGROUND OF THE INVENTION

Wood and solid fuel stoves are used in many places throughout the world. They usually comprise a metal fire-box to contain the solid fuel and the flames produced by the burning of the solid fuel. Access to the fire-box for loading of more fuel, and for cleaning and servicing is by a door in the front (or other) panel of the stove. The solid fuel is supported on a grate that separates the fire-box from the ash-chamber, the grate allowing the burning fuel to be fed by air rising from beneath the grate and allowing spent fuel in the form of ash to fall into the ash-chamber to be collected. The collected ash can be disposed of periodically by removing and emptying a collection pan within the ash-chamber.

Most stoves have some type of regulator to control the supply of air into the fire-box. The regulator may be an adjustable shutter or a wheel.

The combustion efficiency of heating stoves can be impaired by intaking air that is relatively cool. Air may be drawn from the immediate surroundings of the stove or even from outside. The air passes through the air regulator and into the fire-box where it is heated during combustion. The hot exhaust gases that are usually vented through a flue and into a chimney are much hotter than the temperature at which the uncombusted air was supplied to the fire. This results in a loss of energy. The efficiency of heating stoves can be improved by pre-heating the air before it is supplied to the fire-box.

In some stoves the air is supplied from a particular source, for example the supply may come from a conduit installed in the floor of a house leading from outside of the house to the bottom of the stove. It is wasteful to provide conduits during the construction of a house that may not be used (if for example a conventional gas or electrically powered fire is subsequently used). However, if such conduits are not supplied, houses without them would be prevented from using stoves which are designed to take in air through such a system.

SUMMARY OF THE INVENTION

It is an aim of the present invention to alleviate some of the problems discussed above.

According to the invention we provide a heating appliance comprising a fire-box, a separate ash-chamber, grate means between the fire box and the ash chamber, updraught air supply means adapted to provide a supply of updraught air into the fire-box via the ash chamber and the grate means, and pre-heating means adapted to provide a supply of pre-heated combustion air to the fire box, the pre-heating means delivering pre-heated air from a region or passage beneath the ash chamber to an upper region of the fire-box.

The fire box and ash-chamber may be separated by a dividing wall having the grate means therein.

The pre-heating means may have an air intake means below the ash-chamber. The pre-heated air which is supplied to the fire-box at an upper, or top, region of the fire-box may be transported there by air supply means. The air supply means preferably comprises a tube or channel of closed cross-section which preferably extends through the dividing wall. The air supply means may also comprise delivery means which delivers air at the top of the door of the appliance. The delivery means may comprise a passageway extending across the fire-box in the region of the top of the door. The passageway preferably has a delivery slot, which most preferably extends substantially across the width of the door, or at least across a window portion of the door.

Advantageously mixing means is supplied to mix air rising from the fire with the pre-heated air. The mixing means may comprise a guide or deflector, such as a plate, which forces air rising from a fire in the fire-box to pass by the delivery means.

The arrangement of the delivery means and mixing means is preferably such that pre-heated air leaves the delivery means at the top of the door and mixes with air deflected by the mixing means so as to cause a flow of air away from the inside surface of the door. This flow of air may push smoke from the fire away from the door. The flow of air pushing smoke away from the door may be turbulent, the turbulence being caused by the mixing of air deflected by the mixing means, air leaving the delivery means, and air rising from the fire.

The door of the appliance may have an air inlet to the ash chamber.

The air intake means may comprise one or more communication passages running at sides of the fire. However, the air means preferably comprises an aperture provided in an air chamber extending beneath the ash chamber. The air chamber need not necessary extend across the full width or depth of the ash chamber. The air supply entering the air intake means may be controlled by regulating means.

The regulating means is preferably a shutter that can move so as to clear, to obscure, or to partially obscure an orifice leading to the air chamber (or communication passage(s). The closure means may be controlled by a rod, knob or lever which may be located at the front or side of the appliance.

The air chamber preferably defines a space which runs across the width of the appliance. The appliance may comprise a main body that contains or substantially contains the fire-box, ash-chamber, and pre-heating means. The pre-heating means is preferably inside the main body.

Advantageously the appliance is portable.

The base of the appliance may be clear of the floor on which is stands. Preferably legs or a plinth are provided at the base of the stove. Preferably air is taken from the immediate surroundings of the appliance. The air may flow between the base of the appliance and the floor to enter the intake means.

The appliance is preferably a stove.

BRIEF DESCRIPTION OF THE DRAWINGS

An example of a stove embodying the invention will now be described by way of example only with reference to the accompanying drawings of which.

DETAILED DESCRIPTION OF PREFERRED EMBODIMENTS

Figure 1:
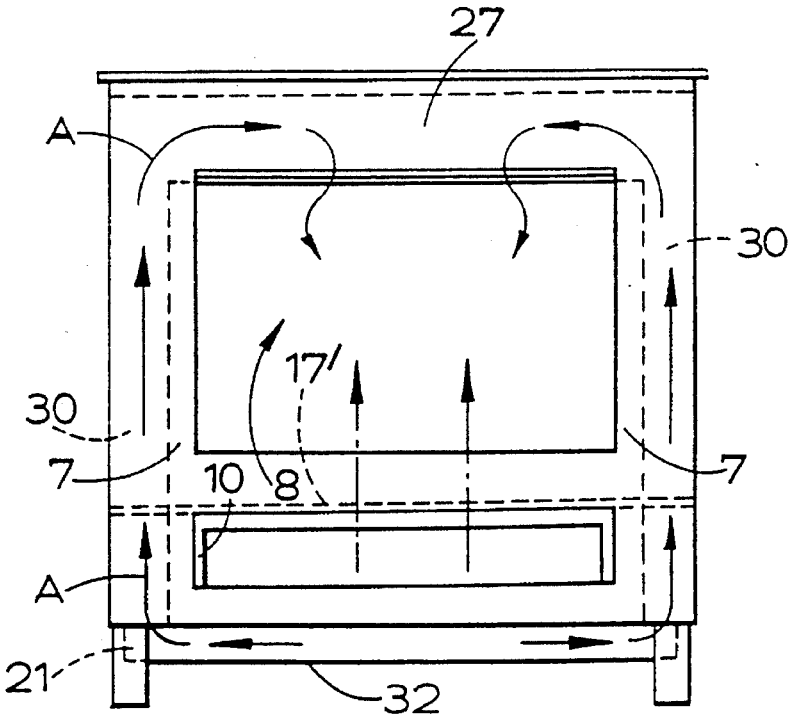
FIG. 1 is a front view of the stove (without its door)

A solid fuel stove 1 is shown in the drawings and has a main body 2 standing on legs 3; a fire box 4 inside the stove 1 in its upper portion; an ash chamber 5 inside the stove 1 below the fire-box 4; and pre-heating means 6 inside the stove 1 below the ash-chamber 5 and extending up the inside of a front panel 7 of the stove 1. A dividing wall 17' separates the fire box from the ash chamber, and a grate 19 is provided in the dividing wall.

There is a large door aperture 8 in the upper part of the front panel 7 of the stove 1 which provides access into the fire-box 4 to replace fuel (not shown).

In the lower part of the front panel 7 is a small aperture 10 beneath the large aperture 8. The small aperture 10 provides access into the ash-chamber 5 to empty ash created by the combustion of fuel.

Both of the apertures are closed by a door 35 which is mounted on hinge lugs 9 fixed to the front panel 7 of the stove 1. The door 35 has a transparent window 36 and an air inlet 37 which can allow air to enter the ash chamber. The air inlet 37 is controlled by aperture control means, such as a "spinner" 38, which may be thermostat controlled. A sealing band 39 extends around the peripheral edge of the door and seals the closed door to the front panel 7 of the body.

The fire-box 4 is in the upper portion of the stove 1 and is formed by the front, back, and side walls of the box 2, and by the dividing wall 17'.

A back wall 11 of the fire-box 4 is protected from the heat of the fire and the hot solid fuel by an insulating/heat resisting layer 12. Insulation is also provided on the side walls of the fire box.

Above the insulating/heat resistant layer of the back wall 11 is an exhaust aperture 13 through which the exhaust gases of the fire pass on the way to a chimney (not shown). Removably mounted on the back wall 11 between the insulating/heat resisting layer 12 and the exhaust aperture is a deflection plate 14, which extends across the entire width of the fire-box 4 and rests on the insulation on the side walls of the fire-box. The deflection plate 14 stops short of the door 35 and so provides a gap 16 between itself and the front panel of the stove. The deflection plate is inclined, and the edge at the back wall 11 of the fire-box 4 is at a level slightly below the top of the large aperture 8 while the front free edge 15 is at a level slightly above the top of the large aperture 8.

As described earlier, the bottom of the fire-box 17 has a dividing wall 17'. The dividing wall 17' is provided with an ash aperture 18 which is covered by a removable grate 19 on which solid fuel can stand. The grate 19 also serves the purpose of allowing communication between the fire-box 4 and the ash-chamber 5 so that waste ash can fall into the ash-chamber 5 and air can rise up through the grate to feed the fire from beneath.

The ash-chamber 5 has two apertures, the small aperture 10 and the waste aperture 18 both of which have been mentioned previously. The ash-chamber 5 collects the waste that falls through the waste aperture 18 in a collection pan 20 which sits beneath the grate 19. The collection pan 20 can be removed from the stove 1 through the small aperture 10 in order to empty the collection pan 20 of waste material.

Beneath the ash-chamber 5, occupying a space across the width and depth of the stove 1 is an air chamber 21 which constitutes part of the pre-heating means 6. The air chamber 21 is at the bottom of the stove 1 inside the body 2. In the bottom of the body 2 is an air aperture 23 which communicates the air chamber 21 with air outside of the stove 1. A regulator plate 24 is slidably movable to cover, partially cover, or uncover the air apertures 23. The regulator plate 24 is moved by a knob 25 which is attached to the plate by a rod 26. Pulling or pushing the knob 25 in or out slides the regulator plate 24 in relation to the air aperture 23.

Air delivery means 27 is provided above the large aperture 8, running across the front panel 7 in the inside of the box 2. The air delivery means 27 is a passage or chamber that has an exit point or slot 28 along its bottom. The slot 28 is provided next to the top of the door and the top of the large aperture 8.

Figure 2:
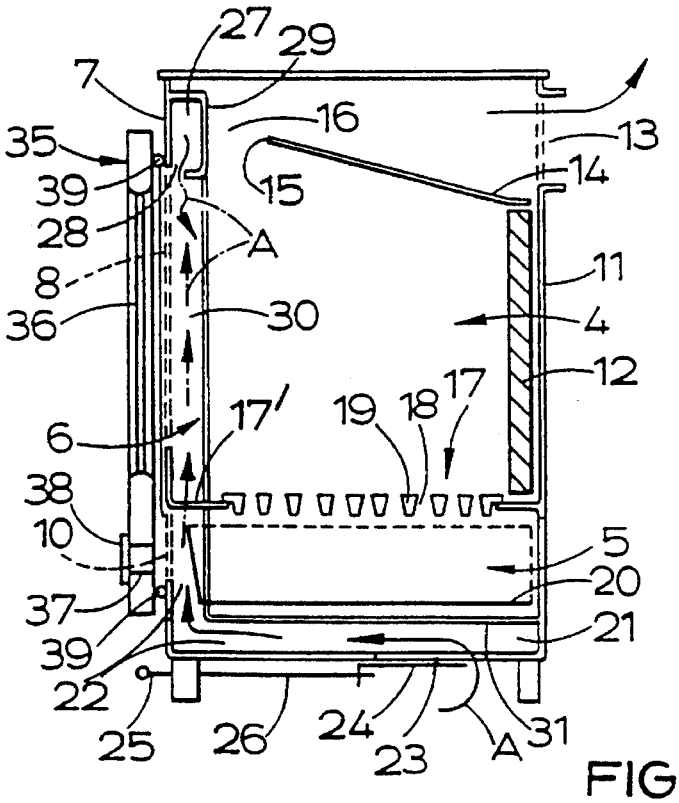
FIG. 2 is a side view of the stove showing some internal structure and including a door.
Figure 3:
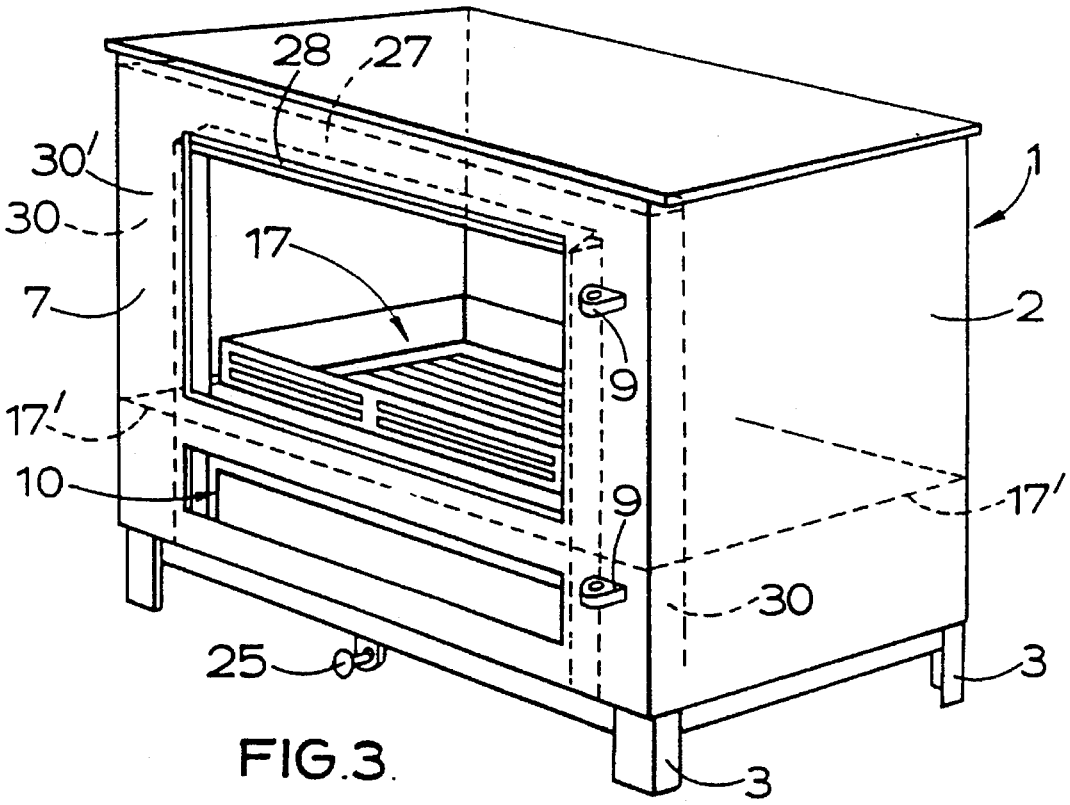
FIG. 3 is a perspective view of the stove (without its door)

The air chamber 21 and the air delivery means 27 are connected by communication channels or passageways 30. The passageways 30 comprise two conduits 30' that run up either side of the large aperture 8 and cut through the dividing wall 17'. There is no direct communication between the passageways 30 and the fire box, only through the slot 28. A continuous air path is formed from the outside of the stove (beneath the stove) to the fire-box 4, through the air aperture 23, along the flat bed of the air chamber 21, up the passageways 30, into the air delivery means 27 and through the slot 28 and into the fire-box 4. This path is shown by the arrows A of FIGS. 1 and 2. It will be noted that the conduits 30' pass through the dividing wall 17'.

The stove 1 is supported by legs 3 for its base 32 to be standing above the level of the floor in order for air to be supplied readily to the air aperture 23.

In operation the fire-box 4 is loaded through the large aperture 8 with solid fuel which rests on the grate 19. The fuel is ignited and once it is burning steadily the door is closed. Until this point the fire was fed by air entering through the large aperture 8, as well as possibly air through the air intake aperture 23 and air through the spinner 38. The knob 25 is pulled out so that the air aperture 23 is open to its fullest extent. The fire draws air to be combusted and air is sucked through the air aperture 23 into the air chamber 21 to rise up the passageway 30 and into the air delivery means 27 and out of the slot 28 into the fire-box. In this way air is drawn through the system comprising the pre-heating means.

During burning, fuel becomes spent and the ash that is created falls into the collection pan 20 in the ash-chamber 5. The ash is hot and the bottom 31 of the ash-chamber 5 becomes hot. The burning of the fuel heats the fire-box 4 considerably and the walls and the connecting means 5 become hot. The hot air from the combustion process rises upwards. The exhaust air hits the deflection plate 14 and as the air continues to rise, it flows along the deflection plate 14 towards the front panel 7. As the exhaust air passes the front edge 15 of the deflection plate, it overshoots and plays over the rear face 29 of the air supply means 27. This may cause a draft in the region of the slot 28. Furthermore, pre-heated air is leaving the slot 28 in a downwards direction. The two airflows mix.

Figure 4:
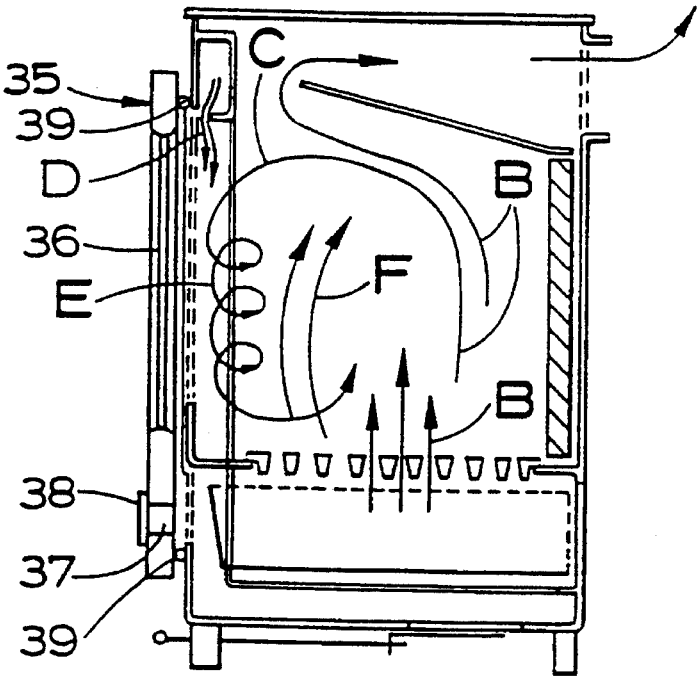
FIG. 4 is a view similar to that of FIG. 2, but showing airflow in more detail.

FIG. 4 illustrates schematically the airflow which is believed to occur in the fire box. There are three main inputs of air: air rising from the fire itself (referenced as B), rising air deflected by the plate 14 (referenced as C), and pre-heated air moving downwards from slot 28 (referenced as D). As the deflected air C meets the pre-heated air D at the top of the door 35 they mix and cause turbulence E at the region of the window 36. This turbulence pushes air, and more importantly soot and smoke F rising from the fire away from the window and keeps the window cleaner than in conventional fires. The introduction of pre-heated air also enables a higher temperature to be achieved, which results in less soot and smoke.

Uncombusted air passing through the pre-heating means 22 is warmed firstly by contacting the bottom 31 of the ash-chamber 5. The draw on air for combustion takes the air up the connecting conduits 30' which are by now hot and the air is heated further. The air receives further pre-heating in passing through the slot 28 and some mixing occurs with the rising and escaping air rising from the deflection plate 14. The draft and/or turbulence caused by the exhaust gases in the region of the front edge 15 of plate 14 may draw air from slot 28, or assist in doing so.

Once the fire in the stove is fully burning, it can be controlled by adjusting the knob 25 which controls the amount of air entering into the fire-box 4.

It is an advantage of the stove that it is constructed to intake an air supply from the room. In this way it is very simple to install and it does not require a conduit to have been previously installed in the house. Therefore the invention provides a stove that is very cheap. The only connection that needs to be made is to connect the flue of the stove to a suitable system to deal with exhaust gases, for example a chimney. Otherwise all that is required is a flat area on which the legs of the stove can stand. A hearth area would be suitable.

In addition, the stove is very compact since all of its elements with the exception of the flue can be housed in a small box.

The fire is clean, can be seen through the window which does not readily dirty, is efficient, and has a relatively high air flow for its compact size.

I claim:

1. A multi-fuel stove comprising:

a housing;

a firebox;

a door having a transparent window;

an ash chamber having a lower wall; a grate;

preheating means provided beneath said ash chamber;

a front wall of said housing;

airwash means;

an updraught air supply;

wherein said housing contains said firebox and said ash chamber, and has a door aperture;

said firebox is provided above said ash chamber, with said grate disposed therebetween;

said door is provided in register with said door aperture;

and wherein said preheating means comprises a chamber, or passageway, provided below said ash chamber, said chamber or passageway being defined in part by said lower wall and communicating with said airwash means, said airwash means comprising a first conduit provided on said front wall of said housing and extending along one side of said door aperture, a second conduit provided on said front wall of said housing and extending along the other side of said door aperture, and a third conduit in communication with said first and second conduits and extending across the top of said door aperture, said first and second conduits both being in communication with said chamber or passageway;

said updraught air supply supplying updraught air to said ash chamber below said grate, said updraught air rising through said grate in use, said updraught air supply having an updraught air supply control to control the air supplied to said ash chamber by said updraught air supply, and wherein said preheating means has a preheated air supply control which controls air provided to said preheating chamber or passage, said preheated air supply control and said updraught air supply being independently controllable;

and wherein said airwash means is adapted to provide preheated air to the inside surface of said door.

2. A stove according to claim 1 wherein there is only one preheated air control.

3. A stove according to claim 1 wherein a wall is provided between said firebox and said ash chamber, and wherein said wall has an aperture in which said grate is provided.

4. A stove according to claim 3 wherein said first and second conduits extend through said wall.

5. A stove according to claim 1 wherein a baffle plate is provided in said firebox.

* * * * *